US006612527B1

(12) United States Patent
Nagel

(10) Patent No.: US 6,612,527 B1
(45) Date of Patent: Sep. 2, 2003

(54) ONE-PIECE, STRAIGHT ENTRY DISPLAY HOOK

(75) Inventor: Thomas O. Nagel, Blairstown, NJ (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 10/138,131

(22) Filed: May 2, 2002

(51) Int. Cl.[7] ..... F21V 35/00

(52) U.S. Cl. ..... 248/220.43; 211/57.1; 211/59.1

(58) Field of Search ..... 248/220.43, 220.42, 248/220.41; 211/57.1, 59.1

(56) References Cited

U.S. PATENT DOCUMENTS

| | | | | | |
|---|---|---|---|---|---|
| 3,195,846 | A | | 7/1965 | Dahlhauser | 248/220.42 |
| 3,853,293 | A | | 12/1974 | Larson | 248/220.42 |
| 4,098,480 | A | * | 7/1978 | Neumann | 248/243 |
| 4,351,440 | A | * | 9/1982 | Thalenfeld | 211/57.1 |
| 4,352,478 | A | | 10/1982 | Loew | 248/22.11 |
| 4,441,619 | A | | 4/1984 | Gibitz | 211/70.6 |
| 4,619,428 | A | * | 10/1986 | Bailey | 248/220.43 |
| 4,662,592 | A | | 5/1987 | Garfinkle | 248/220.42 |
| 5,231,779 | A | * | 8/1993 | Valiulis et al. | 40/649 |
| 6,349,909 | B1 | * | 2/2002 | Zarrow et al. | 248/220.41 |

OTHER PUBLICATIONS

"Excerpt from Catalog of Soutern Imperial, Inc.", date= "Prior to Jan. 23, 2002".

* cited by examiner

*Primary Examiner*—Ramon O. Ramirez
(74) *Attorney, Agent, or Firm*—Schweitzer Cornman Gross & Bondell LLP

(57) ABSTRACT

A one-piece straight-entry display hook device is provided which is highly resistant to dislodgment resulting from upward pressure adjacent to the supporting panel, yet accommodates free upward pivoting movement in response to upward pressure on the hook applied at outer portions thereof. The display hook has a specially configured back plate with upwardly tilted mounting lugs of inverted L-shaped configuration along upper edge portions thereof, and downwardly angled retaining elements projecting from lower edge portions thereof. When the back plate is mounted on an apertured panel, upward movement of the back plate, which might otherwise dislodge the display hook and cause it and its contents to fall off the wall, is prevented by engagement of the retaining elements with a pair of openings in the panel board. If the hook receives upward pressure from a point spaced outwardly from the panel board, the hook is free to tilt upwardly in response, by pivoting about the upper mounting lugs, while the lower retaining elements withdraw partially from the panel board openings below. By upwardly tilting the mounting lugs at the top of the back plate, the back plate is allowed to tilt freely outward when necessary, if bumped near its outer end by store personnel or customers.

17 Claims, 5 Drawing Sheets

FIG. 3
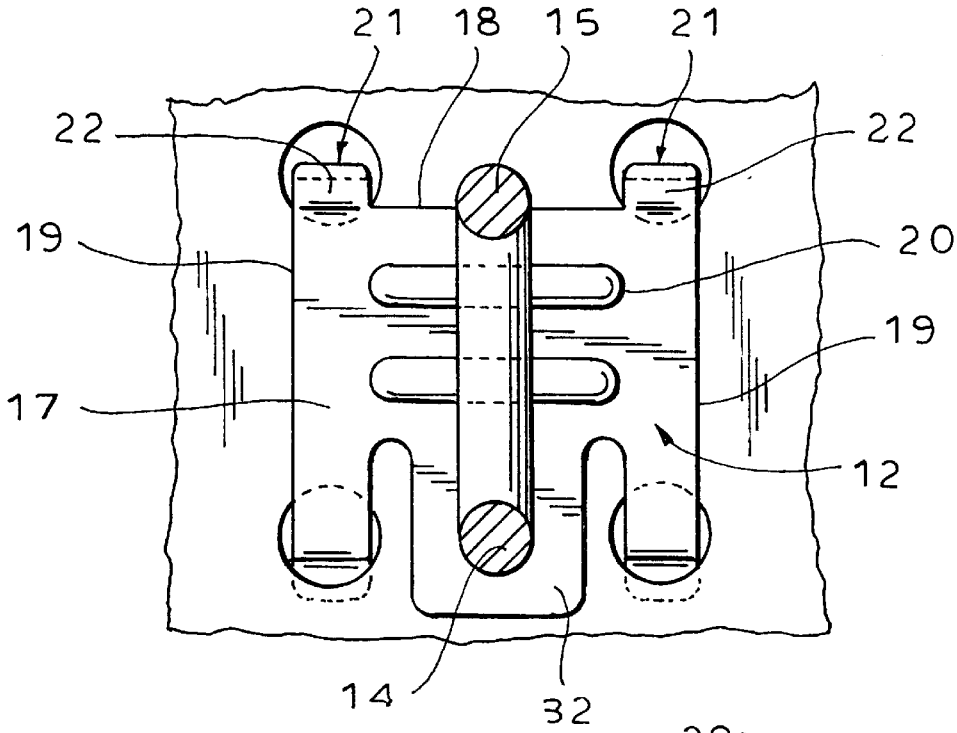
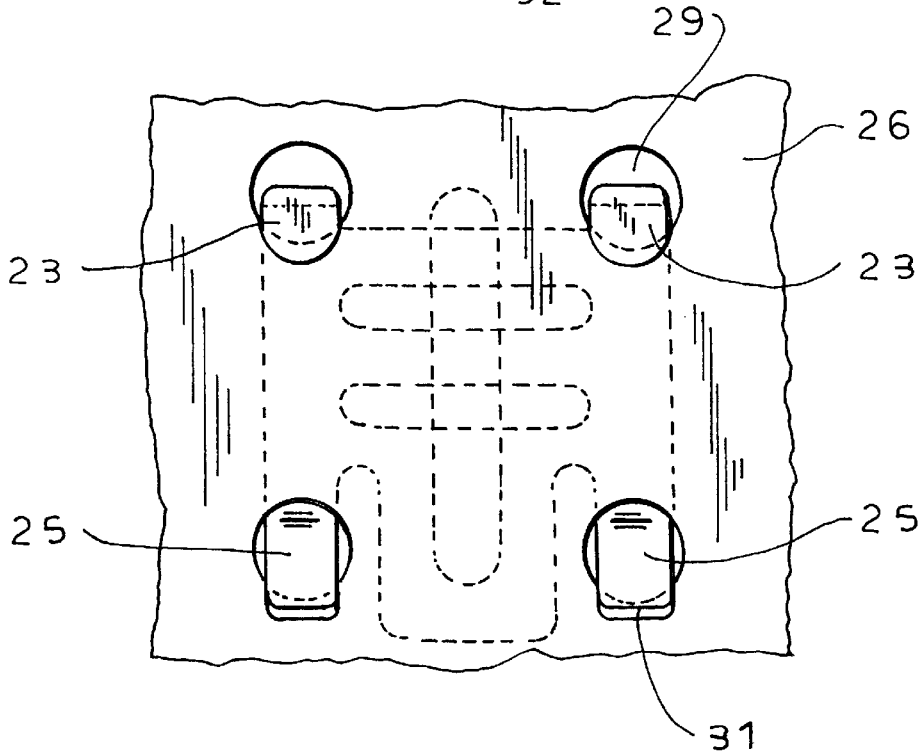
FIG. 4

ONE-PIECE, STRAIGHT ENTRY DISPLAY HOOK

BACKGROUND OF THE INVENTION

Mass merchandisers make wide use of displays utilizing perforated panel board and peg hooks. The hooks include an outwardly extending arm, typically formed of wire, on which a plurality of display products are suspended. A simplified and inexpensive form of such peg hook utilizes a pair of spaced apart, L-shaped lugs by which to engage the peg hook with openings in the perforated panel board. During installation the peg hook is tilted at an upward angle, to enable the normally vertical legs of the L-shaped lugs to be inserted through panel board openings, after which the hook is pivoted downward to its normal position on the panel board. Because display area on panel boards typically is tightly packed with display merchandise, the installation or removal of a particular hook from a product-laden panel can be very difficult. There often is insufficient room below a loaded peg hook to permit upward tilting of the hook beneath it, such that removal or insertion of a single hook may require substantial disturbance of a loaded display panel.

One solution to the above problem has involved forming the peg hook with a pivoting back plate, allowing the back plate to be tilted as necessary to enable the L-shaped lugs to be inserted through the panel board openings, while the main body of the hook remains in a more or less horizontal orientation. This is an acceptable solution to the installation issues, but adds extra cost to the production of the hook.

Another solution involves the use of a two-part hook, with a molded plastic back plate, formed with L-shaped lugs, which mounts a separate wire hook member. This arrangement allows the back plate to be tilted and inserted into the panel board before mounting of the display hook, so that minimal overhead clearance is not a problem. This arrangement also is acceptable in accommodating installation and removal of hooks from fully loaded panels, but has a disadvantage of requiring the handling of two parts.

A still further proposed solution involves the use of a back plate with four, rather than two, mounting lugs, with the lugs being of an inverted L configuration, with the vertical legs of the L being shorter than the diameter of the panel board openings and thus able to be inserted directly through the panel board openings without tilting the hook. After the lugs are inserted through the holes, the back plate is lowered, so that the four lugs engage the back of the panel below the panel board openings (instead of above the openings as is more typical). This arrangement also provides an acceptable way of installing a hook in a crowded display board, but has certain very significant disadvantages. If a loaded hook of this design is jostled upwardly from a point near the panel, the back plate may be displaced upwardly a short distance, allowing the hook to fall out of the openings and off of the display panel. In this respect, the inverted L-shaped lugs have necessarily short vertical portions. Otherwise, they cannot be inserted through the panel board openings, which typically are of one quarter inch diameter. Additionally, if such a hook is hit at or near the outer end of the wire, there is little or no "give" in the hook and back plate, with respect to the panel on which it is mounted. This can result in injury to the customer or store personnel, in damage to the panel board, in damage to the hook, or combinations of the foregoing.

SUMMARY OF INVENTION

Pursuant to the invention, a new and improved form of straight-entry type hook is provided, which can be installed with a minimal and acceptable degree of upwardly tilting of the hook, yet which does not suffer from the disadvantages described above. The new hook is a one-piece device, comprising a back plate and an outwardly extending display hook fixed thereto, typically by welding. The back plate includes a pair of upper panel-engaging lugs of a generally inverted L-shaped configuration, with relatively short downwardly extending elements of the lugs, adapted to be inserted straight into the display panel openings and to be engaged with the back surface of the display panel by a short downward movement of the back plate after insertion of the lugs. Unlike prior devices of this general type, however, the device of the invention does not include a second pair of inverted L-shaped lugs along the bottom portion of the back plate, for engagement with the back surface of the display panel through a second set of panel openings. Instead, the device of the invention includes a pair of downwardly angled retaining elements, which extend through a lower pair of panel openings, but do not make locking engagement with the back surface of the panel. The retaining elements are positioned to significantly restrict the back plate against upward, dislodging movements, in the event the hook is bumped from below at a point near the back plate. However, if the hook element is bumped upwardly from a point at or near its outer end, the hook is free to tilt upwardly, so that injury or damage is not likely to result.

In a preferred embodiment of the invention, the inverted L-shaped upper lugs are angled slightly upwardly, for example, about 12 degrees from a perpendicular orientation with respect to the back plate. This allows the upper lugs of the back plate to somewhat loosely engage the display panel, after the lugs have been inserted through the panel openings and positioned to support the display hook. The retaining elements, angling downward from lower portions of the back plate, are spaced in appropriate distance from the inverted L-shaped lugs such that, if the hook is bumped upwardly from an inside position, near the back plate, upward movement of the back plate, which might otherwise dislodge the hook, is prevented by the retaining elements. However, if the hook is bumped upwardly from an outer end portion, the retaining elements can slide outwardly with respect to the panel openings in which they are inserted, allowing the entire hook assembly to tilt upwardly in response to the bump, to minimize or prevent injury or damage. The upward tilt of the inverted L-shaped lugs is also advantageous in that it efficiently accommodates an upward tilting of the hook in response to an upward bump against an outer portion of the hook.

For a further understanding of the above and other features and advantages of the invention, reference should be made to the following detailed description of a preferred embodiment of the invention, and to the accompanying drawings.

DESCRIPTION OF THE DRAWINGS

FIG. 3 is an enlarged cross sectional view as taken generally on line 3—3 of FIG. 1.

FIG. 4 is a back elevational view of an installed hook.

DESCRIPTION OF PREFERRED EMBODIMENT

Figure 1:
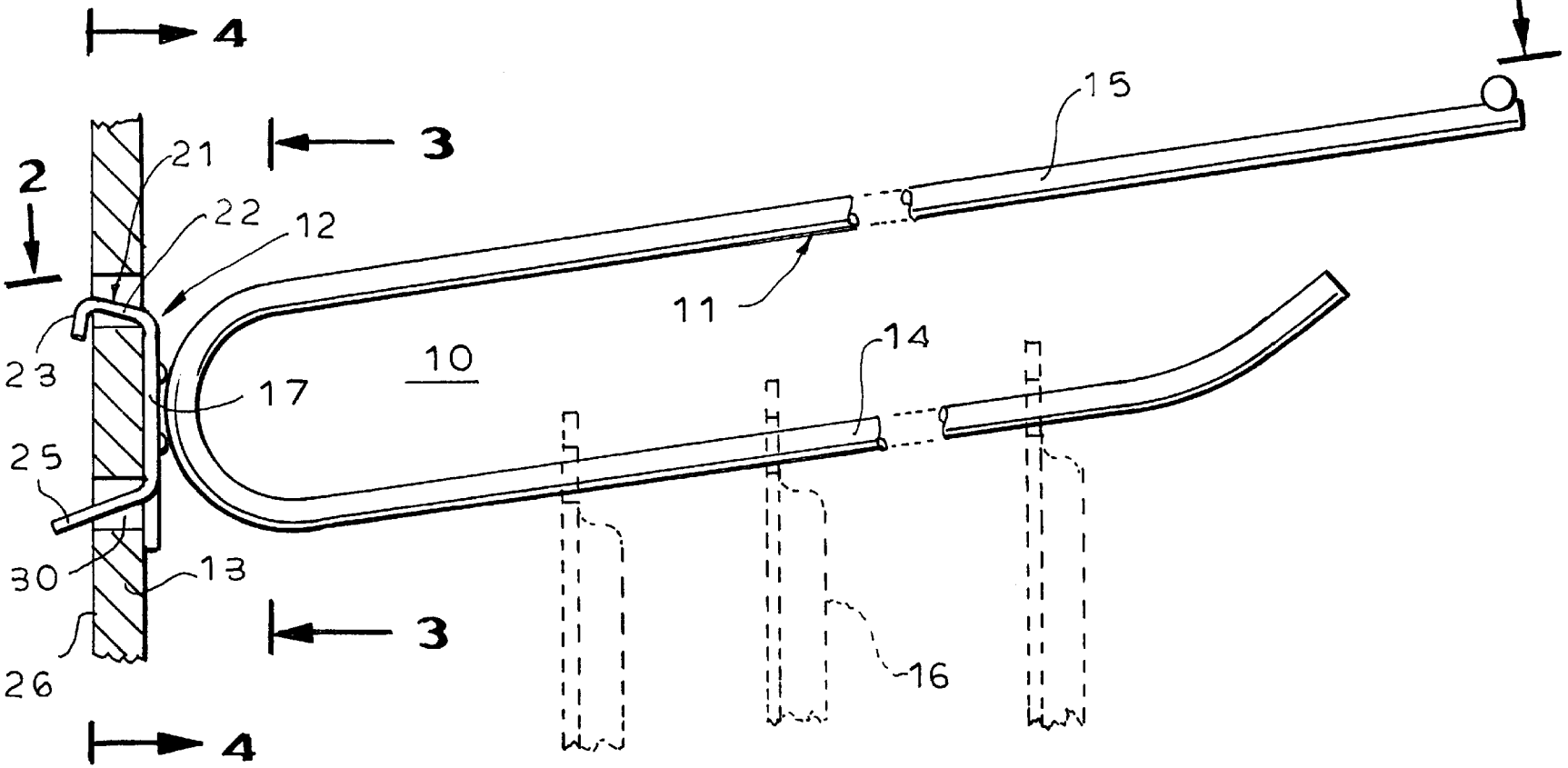
FIG. 1 is a side elevational view, partly in section, showing the new display hook device mounted in an apertured panel board for the display of merchandise.
Figure 2:
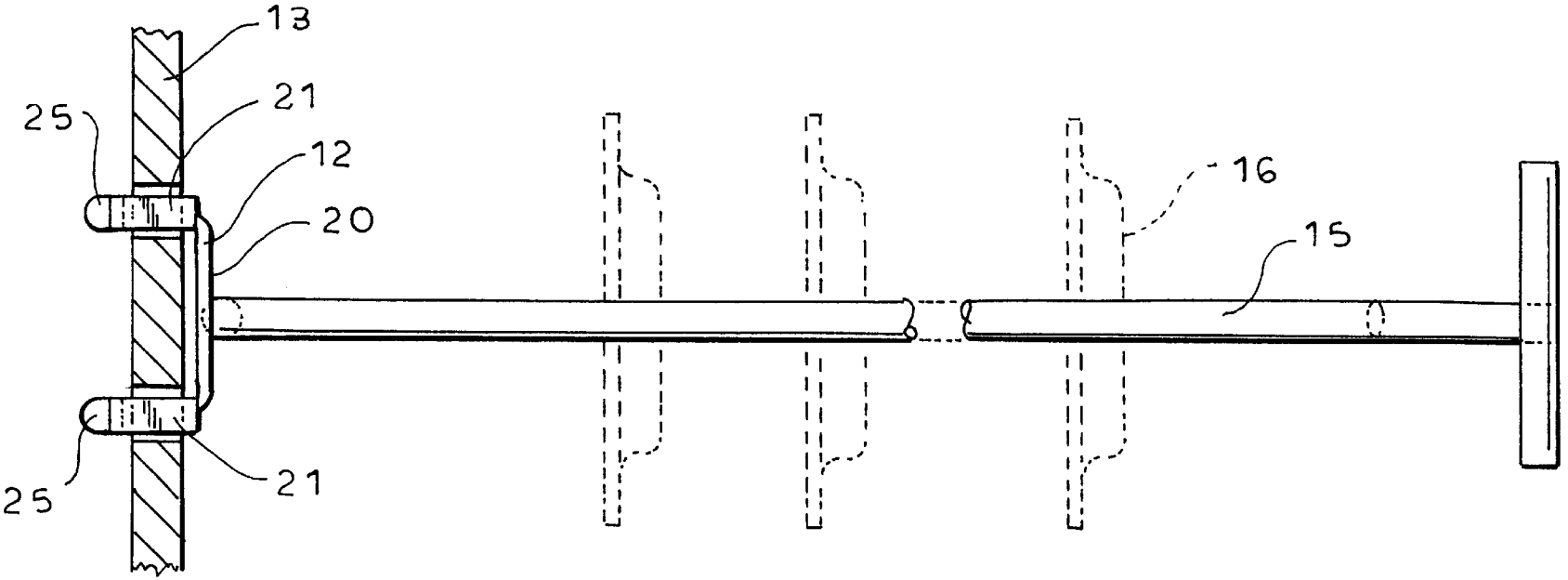
FIG. 2 is a fragmentary top plan view of the hook device of FIG. 1.

Referring now to the drawing, the reference numeral 10 designates generally a display hook device consisting of a wire hook element 11 and a back plate 12. The back plate 12 is suitably mounted, as will be described in greater detail, in an apertured display panel 13 of a well known type. Typically, the display panel may be about one quarter inch in thickness, and provided with openings throughout its surface area spaced apart vertically and horizontally on one inch centers.

In the illustrated form of the invention, the back plate 12 is shaped from a steel plate of about $1/16^{th}$ inch in thickness. The hook portion 11 typically can be formed of steel wire, of for example, $3/16^{th}$ inch in diameter, and is secured by welding to the back plate 12. The hook portion includes at least an outwardly extending merchandise support arm 14 and, in the illustrated form of the invention, also a label support arm 15 extending above and generally parallel to the merchandise support arm 14.

The functioning of the display hooks of this general type is generally well known in the trade. Display merchandise 16, typically but not necessarily mounted on a header card provided with an aperture in its upper portion, is suspended on the merchandise support arm 14, as indicated generally in FIG. 1.

In a typical mass merchandise store, the apertured panel board displays are densely populated with display hooks 10 for the display of a variety of merchandise items. Desirably, the panel is set up in such manner that there are minimal spaces between display packages, both horizontally and vertically, in order to be able to display a maximum number of merchandise items 16 in a given display area.

In accordance with the present invention, the back plate 12 is specially designed and configured to allow for substantially straight-in installation of the back plate on the display panel 13, with a minimal upward tilting requirement of the hook portion 11, so as not to result in interference with packaging displayed directly above. The back plate 12 is comprised of a generally flat main panel portion 17 formed with an upper edge 18 and generally parallel opposite side edges 19. The center area of the panel advantageously is provided with a pair of vertically spaced rib projections 20 which provide concentrated attachment points for mounting of the hook 11 by electric resistance welding, for example.

Mounting lugs 21 extend rearwardly from the upper edge portion 18 of the back plate, adjacent each side edge thereof. Pursuant to the invention, the mounting lugs 21 are of an inverted L-shaped configuration, consisting of a generally rearwardly extending portion 22 and a generally downwardly extending portion 23. Typically and desirably, the portions 22, 23 form a right angle.

According to the invention, the rearwardly extending portions 22 of the lugs 21 preferably are angled slightly upwardly, for example at an angle of around 76 degrees–80 degrees to a plane defined by the main panel 17 of the back plate. The downwardly extending portions 23 of the mounting lugs, advantageously are disposed at 90 degrees to the rearwardly extending portions 22, forming a preferred angle of about 12 degrees to the plane of the back plate panel 17.

In a conventional apertured display panel, openings are provided on one inch spacing, and typically are about ¼ inch in diameter. To accommodate insertion of the mounting lugs 22 in apertures of such size and spacing, the mounting lugs advantageously have a width of about 0.200 inch, being spaced apart about 1.195 inch between outside edges and about 0.795 inch between inside edges. The end extremities of the downwardly extending elements 23 advantageously are rounded to a semicircular configuration, to facilitate straight entry insertion into the display panel openings 29.

In the device of the invention, the back plate panel 17 is provided adjacent lower edge portions thereof with downwardly and rearwardly extending retaining elements 25. These are of the same spacing and width, generally, as the mounting lugs 22 an are positioned to be received in a pair of display panel apertures 30 located directly below the apertures 29 in which the mounting lugs 22 are inserted.

Pursuant to the invention, the retaining elements 25 extend downwardly and rearwardly from the back plate main panel 17, at an angle of about 69 degrees–73 degrees to the plane of the back plate panel 17, and preferably at an angle of 71 degrees to the plane of the panel. The retaining elements may be generally straight, but also may be curved slightly upward toward the rear, if desired. The retaining elements 25 have a length which is preferably substantially greater than the thickness of the panel board 13, so as to project beyond the back surface 26 of the panel, when the hook and back plate are installed in normal positions. In the illustrated form of the invention, the retaining elements 25 may have an overall length on the order of 0.56 inch. The end extremities 31 of the retaining elements 25 advantageously are rounded to facilitate their entry into the circular holes 30 of the panel board during installation of a hook as described.

The vertical distance between the inside corners 27, 28 formed between the main panel 17 of the back plate, and the mounting lugs 21 and retaining elements 25 respectively is significant and should be such as to substantially restrict vertical movement of the back plate 12, when installed in its normal display position, as shown in FIG. 1. Thus, in the preferred form of the invention, the vertical spacing between the inside corners 27, 28 is approximately 0.800 inch, which will provide a close fit of the lugs 22 and retaining elements 25 in the vertically spaced openings 29, 30. In this respect, the openings 29, 30 are spaced on one inch centers, and the openings typically are of 0.250 inch diameter. Thus, the distance between the lowest point of the upper opening 29 and the highest point of the lower opening 30 (referred to herein as the edge-to-edge distance between the openings) is 0.750 inch. However, since these openings are circular, and the mounting lugs 22 and retaining elements 25, are of generally flat contours, they do not extend fully into the lowermost and uppermost portions of these circular openings. Instead, they engage the openings at a small distance removed from their vertical extremities. Thus, although the edge-to-edge distance between vertically adjacent openings is nominally less than the distance between the corners 27, 28, there is actually only a minimal clearance space for upward movement of the back plate.

Figure 5:
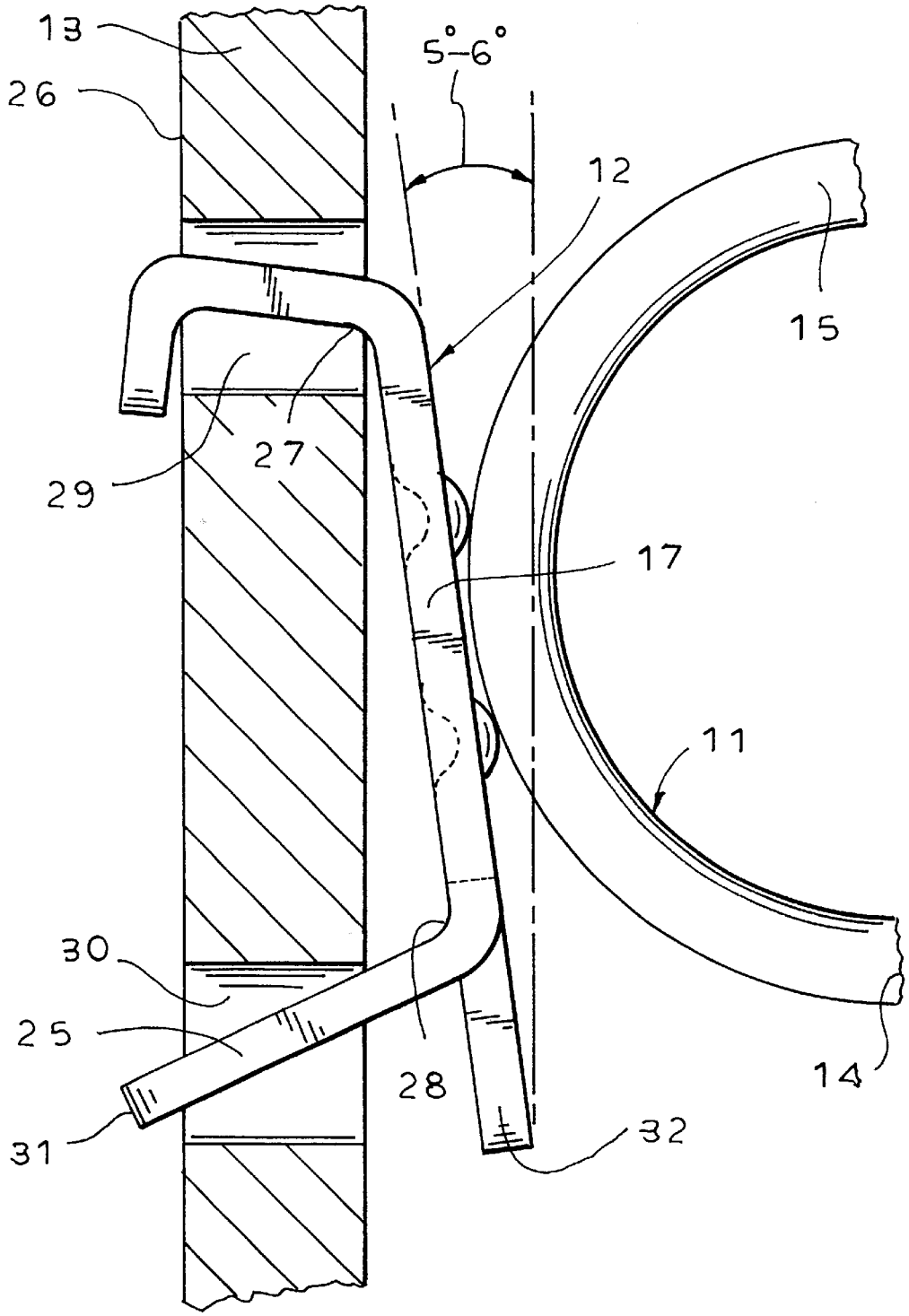
FIG. 5 is an enlarged, fragmentary view of the new hook device, illustrating the manner of inserting the back plate of the hook into an apertured panel board.
Figure 6:
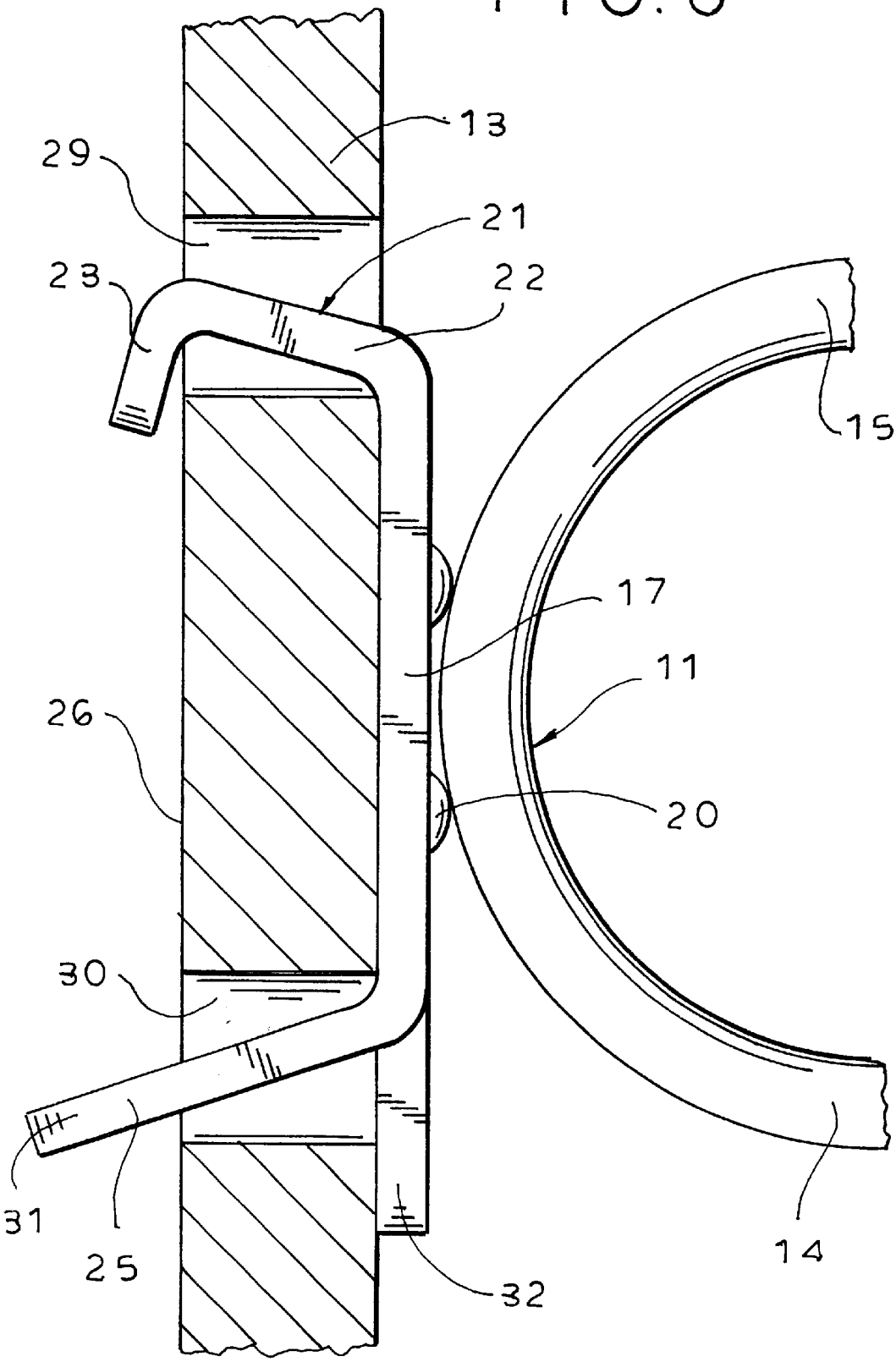
FIG. 6 is an enlarged fragmentary elevation view illustrating the hook immediately after insertion into the panel board.

Installation of the new display hook device in a display panel is illustrated in the views of FIGS. 5 and 6. As the back plate is moved toward the panel openings 29, 30 the hook is tipped up slightly, for example, 5–6 degrees, substantially as shown in FIG. 5, to enable the mounting lugs 22 to enter and pass through the upper opening 29. At the same time, the end extremities of the retaining elements 25 are aligned to enter the lower openings 30. When the lugs 22 have been inserted through the upper openings 25, a simultaneous downward rotation (untilting) and lowering of the back plate 12 enables the retaining elements 25 to pass through the lower openings 30 and allows the downwardly extending portions 23 of the mounting lugs to be seated behind the display panel surface 26, substantially as shown in FIG. 6.

To advantage, the back plate 12 is provided with a downward extension 32 which is positioned between the retaining elements 25 and projects downward for a distance of, for example, ⅜th inch, providing additional leverage to resist the weight of display products supported on the hook 11.

The display hook device of the invention has very important advantages in providing for the straight-entry installation of a one-piece hook device while at the same time avoiding the critical disadvantages of accidental dislodgment of the hook by an upward blow on the hook adjacent to the display panel, or causing injury to a person and/or damage to the hook and/or panel as a result of bumping the hook near its outer end. With the display hook device of the invention, upward pressure on the hook closely adjacent to the display panel 13 does not result in an upward, dislodging movement of the hook, because the retaining elements 25 are in contact with or closely adjacent to upper extremities of the lower panel openings 30. Thus, upward movement of the back plate is either prevented altogether, or sufficiently restricted that the mounting lugs 23 can not become dislodged from the upper openings 29 in which they are seated. At the same time, should the hook receive upward pressure at a point farther out on the hook, the hook is free to tilt upwardly, pivoting about the point at which the inside corner 27 engages the upper opening 29, while the retaining elements 25 are free to withdraw partially from the lower openings 30.

In a preferred form of the invention, the spacing between the back surface of the back plate panel 17 and the front surface of the downwardly extending element 23 of the mounting lug 21 may be slightly greater than the thickness of the display panel 13. Thus, when the hook device is installed, the display panel normally is not tightly gripped between the back plate panel and the lug element 23. Rather, there typically is at least a small clearance, which allows the back plate to tilt forwardly slightly, until the mounting lug element 23 engages the back surface 26 of the display panel. This provides for a somewhat loose mounting of the display hook, which is desirable from the standpoint of enabling some free movement of the display hook device, should it be bumped in the course of normal usage.

During an upward tilting movement of the display hook, resulting from upward pressure against an outer portion of the hook, the back plate will pivot about an inside corner 27 until the rearwardly extending portions 22 of the mounting lugs are horizontal. In the illustrated form of the invention, this would be after 12 degrees of upward tilt. Any additional upward tilting would result in pivoting the back plate about an inside corner 33 formed between mounting lug elements 22, 23.

The display hook device of the invention thus achieves desirable advantages of a one-piece, straight-entry hook, while completely eliminating the significant and potentially dangerous disadvantages of previously known designs for such straight-entry hooks.

The hook device of the invention simultaneously makes mounting of the hook device more positive and reliable, while at the same time accommodating a necessary degree of motion of the hook to prevent injury or damage in the case of an upward bump against an outer portion of the hook.

The display hook of the invention is capable of being manufactured on a high production basis at low cost, because the specially configured back plate is easily formed by routine metal stamping operations.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A display hook device for the display of merchandise on display panels, provided with vertically spaced apart openings, which comprises, (a) a display hook having at least one forwardly extending arm for the support of display merchandise, and (b) a back plate, fixed to said display hook and having elements for engagement with openings in said display panel, (c) said back plate comprising a main panel joined with said display hook, (d) at least one mounting lug extending in a rearward direction from an upper portion of said back plate main panel and adapted for insertion into a first opening in said display panel, (e) said mounting lug having a rearwardly extending support element and a display panel engaging element extending downwardly from a rear edge portion of the support element, (f) at least one retaining element extending rearwardly from a lower portion of said back plate main panel and adapted for insertion into a second opening in said display panel located below the first opening, (g) said retaining element being configured to accommodate tilting movement of said back plate in the mounted condition of said display hook on said display panel in a direction to rotate its lower portions away from said display panel while restricting upward movement of said back plate relative to said display panel, to maintain said mounting lug in engagement with said display panel.

2. A display hook device according to claim 1, wherein (a) said display panel is a perforated panel board provided with horizontally and vertically spaced apart openings, (b) said back plate includes a pair of laterally spaced apart mounting lugs adapted for insertion into a pair of horizontally spaced apart first openings in said display panel, and (c) said back plate further includes a pair of laterally spaced apart retaining elements adapted for insertion into a pair of horizontally spaced apart second openings located below the first openings.

3. A display hook device according to claim 2, wherein (a) said mounting lugs and said retaining elements at junctures thereof with said back plate main panel form upper and lower inside corners respectively with said back plate main panel, and (b) a distance between said upper and lower inside corners is not substantially greater than the edge-to-edge distance between the openings in which said mounting lugs and retaining elements are received whereby, when said display hook is in a mounted position on said display panel, said retaining elements substantially restrict upward movement of said back plate relative to said display panel in response to upward pressure applied to said display hook at a point adjacent to said display panel.

4. A display hook device according to claim 1, wherein (a) said at least one mounting lug and said at least one retaining element at junctions thereof with said back plate main panel form upper and lower inside corners respectively with said back plate main panel, and (b) the distance between said upper and lower inside corners is not substantially greater than the edge-to-edge distance between the openings in which said mounting lugs and retaining elements are received whereby, when said display hook is in a mounted position on said display panel, said at least one retaining element substantially restricts upward movement of said back plate relative to said display panel in response to upward pressure applied to said display hook at a point adjacent to said display panel.

5. A display hook device for the display of merchandise on display panels, provided with vertically spaced apart openings, which comprises, (a) a display hook having at least one forwardly extending arm for the support of display merchandise, and (b) a back plate, fixed to said display hook and having elements for engagement with openings in said display panel, (c) said back plate comprising a main panel joined with said display hook, (d) at least one mounting lug extending in a rearward direction from an upper portion of said back plate main panel and adapted for insertion into a first opening in said display panel, (e) said mounting lug having a rearwardly extending support element and a display panel engaging element extending downwardly from a rear edge portion of the support element, (f) at least one retaining element extending rearwardly from a lower portion of said back plate main panel and adapted for insertion into a second opening in said display panel located below the first opening, (g) said retaining element being configured to accommodate tilting movement of said back plate in a direction to rotate its lower portions away from said display panel while restricting upward movement of said back plate to maintain said mounting lug in engagement with said display panel, (h) said display panel comprising a perforated panel board provided with horizontally and vertically spaced apart openings, (i) said back plate including a pair of laterally spaced apart mounting lugs adapted for insertion into a pair of horizontally spaced apart first openings in said display panel, (j) said back plate further including a pair of laterally spaced apart retaining elements adapted for insertion into a pair of horizontally spaced apart second openings located below the first openings, (k) said mounting lugs and said retaining elements forming upper and lower inside corners respectively with said back plate main panel, and (l) a distance between said upper and lower inside corners being not substantially greater than the edge-to-edge distance between the openings in which said lugs and retaining elements are received whereby, when said display hook is mounted on said display panel, said retaining elements substantially restrict upward movement of said back plate relative to said display panel in response to upward pressure applied adjacent to said display panel, (m) said retaining elements extending in a generally downward and rearward angular direction from said back plate main panel, and (n) said retaining elements having a length which is greater than a thickness of said display panel, whereby said retaining elements continue to be received in said second openings when said back plate is tilted upwardly with respect to said display panel.

6. A display hook device according to claim 5, wherein (a) said retaining elements are of a sufficiently straight configuration to enable said retaining elements to move freely in generally forward and rearward directions said second openings in response to tilting movement of said back plate.

7. A display hook device for the display of merchandise on display panels, provided with vertically spaced apart openings, which comprises, (a) a display hook having at least one forwardly extending arm for the support of display merchandise, and (b) a back plate, fixed to said display hook and having elements for engagement with openings in said display panel, (c) said back plate comprising a main panel joined with said display hook, (d) at least one mounting lug extending in a rearward direction from an upper portion of said back plate main panel and adapted for insertion into a first opening in said display panel, (e) said mounting lug having a rearwardly extending support element and a display panel engaging element extending downwardly from a rear edge portion of the support element, (f) at least one retaining element extending rearwardly from a lower portion of said back plate main panel and adapted for insertion into a second opening in said display panel located below the first opening, (g) said retaining element being configured to accommodate tilting movement of said back plate in a direction to rotate its lower portions away from said display panel while restricting upward movement of said back plate to maintain said mounting lug in engagement with said display panel, (h) said display panel comprising a perforated panel board provided with horizontally and vertically spaced apart openings, (i) said back plate including a pair of laterally spaced apart mounting lugs adapted for insertion into a pair of horizontally spaced apart first openings in said display panel, (j) said back plate further includes a pair of laterally spaced apart retaining elements adapted for insertion into a pair of horizontally spaced apart second openings located below the first openings, and (k) the rearwardly extending support elements of said mounting lugs are angled upwardly and rearwardly from said back plate main panel.

8. A display hook device according to claim 7, wherein (a) the display panel engaging elements of said mounting lugs extend downwardly generally at right angles to said support elements.

9. A display hook device according to claim 8, wherein (a) said back plate main panel is oriented in a plane, and (b) said support elements are angled upwardly at an angle of about 76°–80° with respect to said plane.

10. A display hook device for the display of merchandise on display panels, provided with vertically spaced apart openings, which comprises, (a) a display hook having at least one forwardly extending arm for the support of display merchandise, and (b) a back plate, fixed to said display hook and having elements for engagement with openings in said display panel, (c) said back plate comprising a main panel joined with said display hook, (d) at least one mounting lug extending in a rearward direction from an upper portion of said back plate main panel and adapted for insertion into a first opening in said display panel, (e) said mounting lug having a rearwardly extending support element and a display panel engaging element extending downwardly from a rear edge portion of the support element, (f) at least one retaining element extending rearwardly from a lower portion of said back plate main panel and adapted for insertion into a second opening in said display panel located below the first opening, (g) said retaining element being configured to accommodate tilting movement of said back plate in a direction to rotate its lower portions away from said display panel while restricting upward movement of said back plate to maintain said mounting lug in engagement with said display panel, (h) said display panel comprising a perforated panel board provided with horizontally and vertically spaced apart openings, (i) said back plate including a pair of laterally spaced apart mounting lugs adapted for insertion into a pair of horizontally spaced apart first openings in said display panel, (j) said back plate further including a pair of laterally spaced apart retaining elements adapted for insertion into a pair of horizontally spaced apart second openings located below the first openings, (k) said mounting lugs and said retaining elements forming upper and lower inside corners respectively with said back plate main panel, (l) a distance between said upper and lower inside corners being not substantially greater than the edge-to-edge distance between the openings in which said lugs and retaining elements are received whereby, when said display hook is mounted on said display panel, said retaining elements substantially restrict upward movement of said back plate relative to said display panel in response to upward pressure applied adjacent to said display panel, (m) said back plate main panel being oriented in a plane, and (n) said retaining elements being angled downwardly at an angle of about 69°–73°.

11. A display hook device according to claim 10, wherein (a) said display panel is of a predetermined thickness, and (b) said retaining elements have length of at least about two times said predetermined thickness.

12. A display hook device for the display of merchandise on display panels, provided with vertically spaced apart openings, which comprises, (a) a display hook having at least one forwardly extending arm for the support of display merchandise, and (b) a back plate, fixed to said display hook and having elements for engagement with openings in said display panel, (c) said back plate comprising a main panel joined with said display hook, (d) at least one mounting lug extending in a rearward direction from an upper portion of said back plate main panel and adapted for insertion into a first opening in said display panel, (e) said mounting lug having a rearwardly extending support element and a display panel engaging element extending downwardly from a rear edge portion of the support element, (f) at least one retaining element extending rearwardly from a lower portion of said back plate main panel and adapted for insertion into a second opening in said display panel located below the first opening, (g) said retaining element being configured to accommodate tilting movement of said back plate in a direction to rotate its lower portions away from said display panel while restricting upward movement of said back plate to maintain said mounting lug in engagement with said display panel, (h) said at least one retaining element extending in a generally downward and rearward angular direction from said back plate main panel, and (i) said retaining element having a length which is greater than a thickness of said display panel, whereby said retaining element continues to be received in said second opening when said back plate is tilted with respect to said display panel.

13. A display hook device according to claim 12, wherein (a) said back plate main panel is oriented in a plane, and (b) said retaining element is angled downwardly at an angle of about 69°–73° with respect to said plane.

14. A display hook device according to claim 13, wherein (a) said retaining element is of a sufficiently straight configuration to enable said retaining element to move freely in said second opening in response to tilting movement of said back plate.

15. A display hook device for the display of merchandise on display panels, provided with vertically spaced apart openings, which comprises, (a) a display hook having at least one forwardly extending arm for the support of display merchandise, and (b) a back plate, fixed to said display hook and having elements for engagement with openings in said display panel, (c) said back plate comprising a main panel joined with said display hook, (d) at least one mounting lug extending in a rearward direction from an upper portion of said back plate main panel and adapted for insertion into a first opening in said display panel, (e) said mounting lug having a rearwardly extending support element and a display panel engaging element extending downwardly from a rear edge portion of the support element, (f) at least one retaining element extending rearwardly from a lower portion of said back plate main panel and adapted for insertion into a second opening in said display panel located below the first opening, (g) said retaining element being configured to accommodate tilting movement of said back plate in a direction to rotate its lower portions away from said display panel while restricting upward movement of said back plate to maintain said mounting lug in engagement with said display panel, and (h) the rearwardly extending support element of said at least one mounting lug being angled upwardly and rearwardly from said back plate main panel.

16. A display hook device according to claim 15, wherein (a) the display panel engaging element of said mounting lug extends downwardly generally at a large angle to said support element.

17. A display hook device according to claim 16, wherein (a) said back plate main panel is oriented in a plane, and (b) said support element is angled upwardly at an angle of about 76°–80° with respect to said plane.

* * * * *